United States Patent [19]

Bruner

[11] 4,342,439

[45] Aug. 3, 1982

[54] APPARATUS FOR TEMPORARILY HANGING FOR ALIGNING CABINETS AND THE LIKE

[76] Inventor: Wally Bruner, 6016 Telegraph Rd., Alexandria, Va. 22310

[21] Appl. No.: 107,244

[22] Filed: Dec. 26, 1979

[51] Int. Cl.[3] ..... F16M 13/00; A47B 67/02

[52] U.S. Cl. ..... 248/544; 312/245

[58] Field of Search ..... 248/224.4, 554, 544; 312/245

[56] References Cited

U.S. PATENT DOCUMENTS

| | | | |
|---|---|---|---|
| 556,612 | 3/1896 | Bingaman . | |
| 601,144 | 3/1898 | Howe | 312/245 |
| 666,810 | 1/1901 | Lake . | |
| 2,521,134 | 9/1950 | Stanitz | 312/245 |
| 2,632,684 | 3/1953 | Anderson . | |
| 2,733,887 | 2/1956 | Schmidt | 248/224.4 |
| 2,939,755 | 6/1960 | Wyant . | |
| 3,025,122 | 3/1962 | Millman . | |
| 3,222,116 | 12/1965 | Levenberg . | |
| 3,346,314 | 10/1967 | Acton . | |
| 3,791,709 | 2/1974 | Cross . | |
| 3,881,676 | 5/1975 | Reinwall | 248/224.4 |
| 3,899,228 | 8/1975 | Schreiber . | |
| 3,908,831 | 9/1975 | Brendgord . | |
| 3,950,049 | 4/1976 | Drass . | |
| 3,953,093 | 4/1976 | Hero . | |
| 4,165,852 | 8/1979 | Chervenak . | |
| 4,228,982 | 10/1980 | Sellera | 312/245 |

FOREIGN PATENT DOCUMENTS

| | | |
|---|---|---|
| 2276019 | 6/1974 | France . |
| 872061 | 7/1961 | United Kingdom . |

*Primary Examiner*—Doris L. Troutman
*Attorney, Agent, or Firm*—John J. Byrne

[57] ABSTRACT

An apparatus for temporarily hanging relatively heavy loads to be mounted upon a generally vertical wall surface to facilitate vertical and horizontal alignment and placement prior to permanent installation.

The apparatus includes an elongate mounting strip (32) which may be horizontally attached to a wall surface, said mounting strip having a plurality of slits (46) fashioned inwardly along an edge thereof and thereby form a plurality of tab members (48) across said edge. At least some of the tabs may be operably inclined outwardly from said generally flat mounting strip (32) such that a cabinet may engage the tabs and thereby hang from the elongate mounting strip in a plumb posture for lateral positioning prior to permanent mounting upon the wall surface.

12 Claims, 14 Drawing Figures

FIG. 2
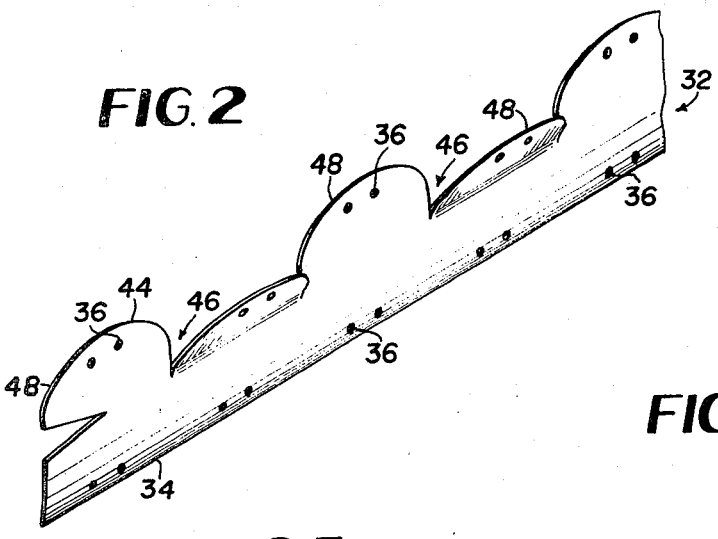
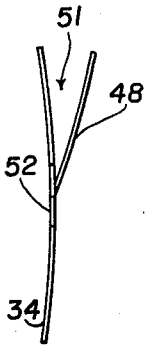
FIG. 4
FIG. 3
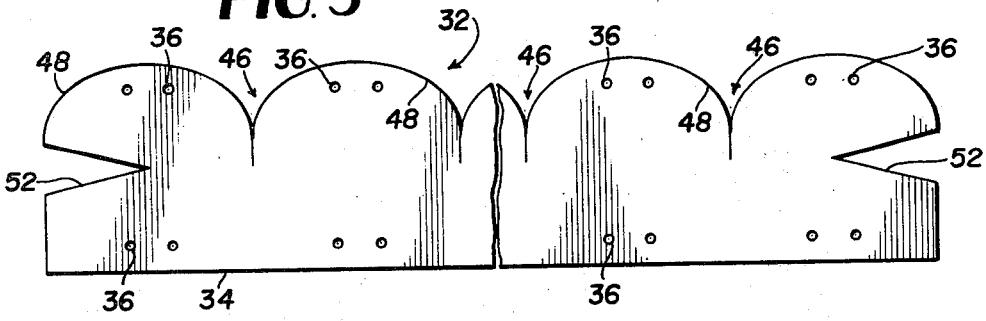
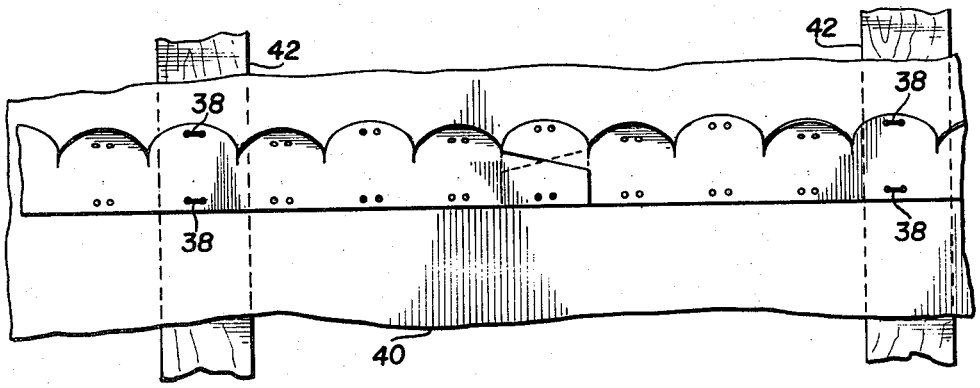
FIG. 5

FIG. 6
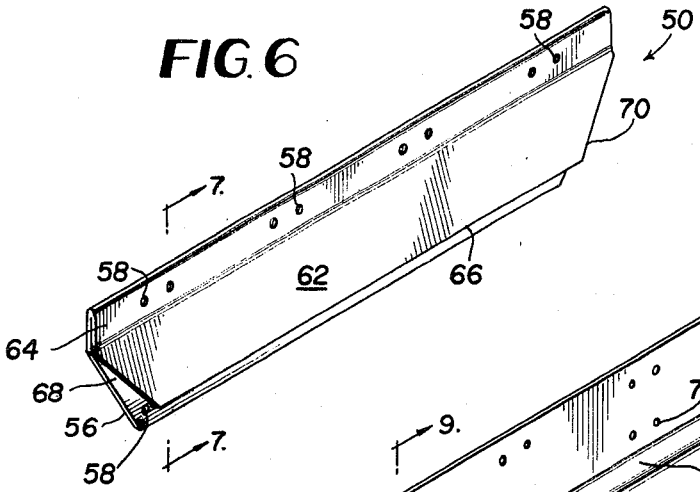
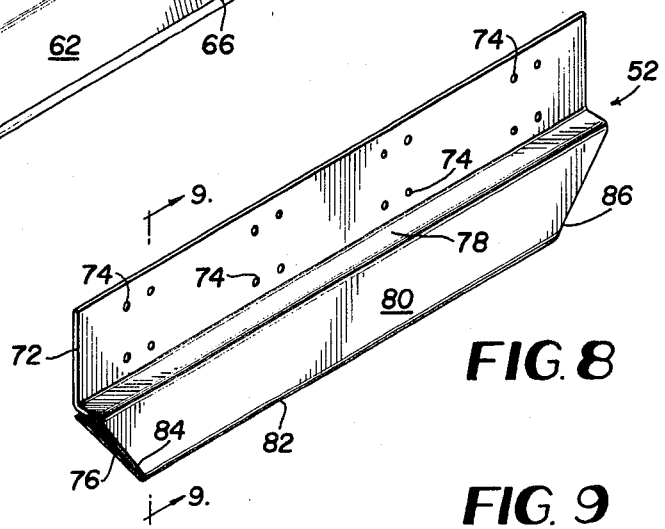
FIG. 8
FIG. 7
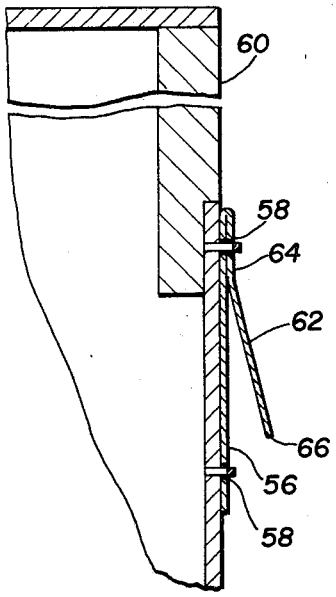
FIG. 9
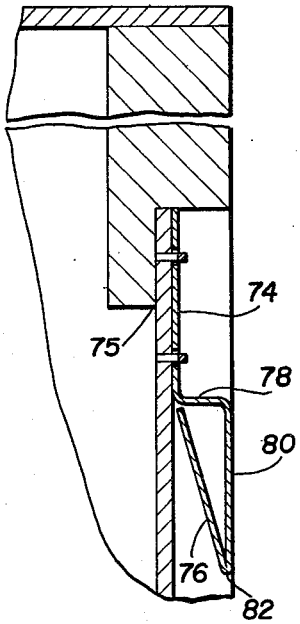

FIG. 10
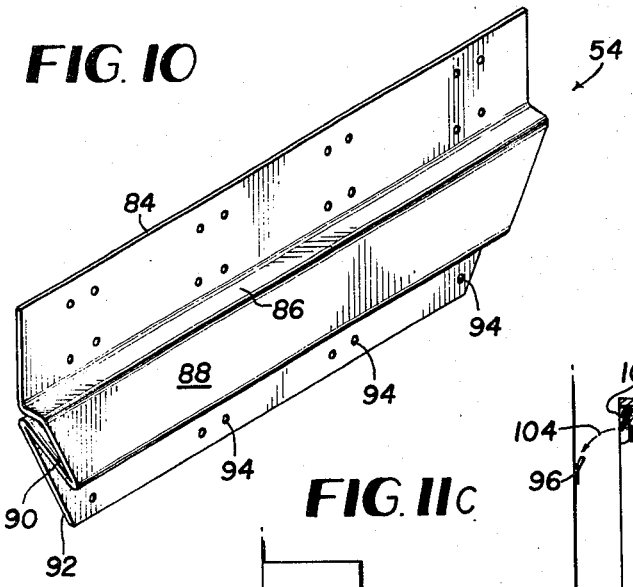
FIG. 11a
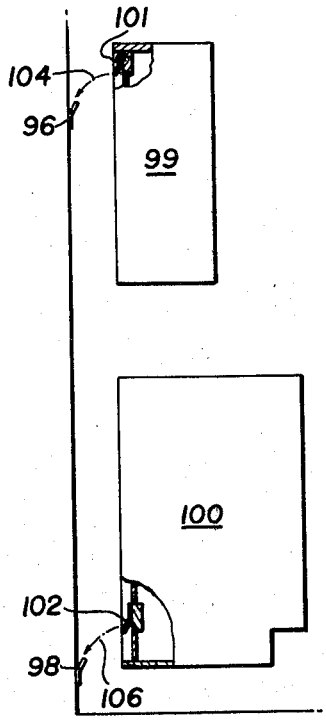
FIG. 11c
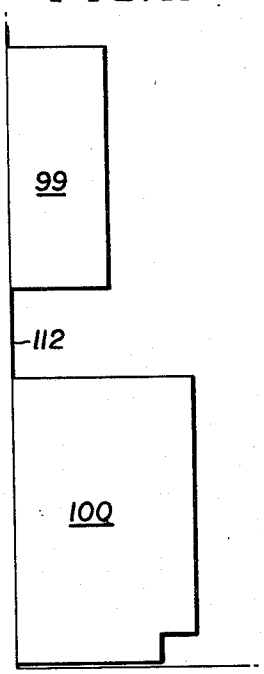
FIG. 12
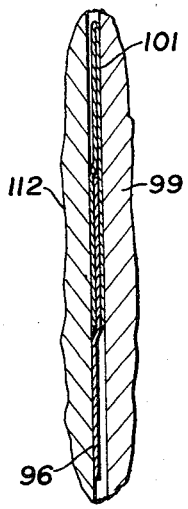
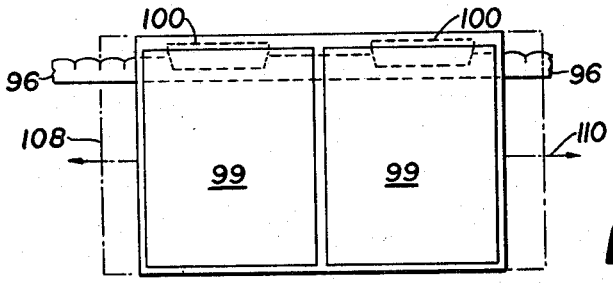
FIG. 11b

APPARATUS FOR TEMPORARILY HANGING FOR ALIGNING CABINETS AND THE LIKE

BACKGROUND OF THE INVENTION

This invention relates to apparatus for temporarily hanging relatively heavy loads to be mounted upon a generally vertical wall surface to facilitate vertical and horizontal alignment and placement prior to permanent installation. More specifically this invention relates to temporarily hanging wall cabinets and the like in a plumb posture and laterally adjusting the same to a desired location prior to permanently mounting the cabinets upon a wall surface.

Modular wall units such as cabinets, shelves, storage bins, closures, mirrors, etc. have been extensively utilized in various industry, business and home environments. While such uses vary widely, an example of a universally encountered application of wall hung units comprises storage cabinets in home kitchens.

In the past, relatively heavy wall units were installed by at least a two man team. A carpenter would normally work with a journeyman or helper who would hold a cabinet in a generally desired location while the carpenter would align and then screw or nail a back mounting portion of the cabinet to studs within a wall. Due to various irregularities in the wall surface, the weight of the cabinets and an often awkward working location, cabinet alignment and mounting was a somewhat time consuming operation and it was relatively easy for even skilled workmen to inadvertently cant or misalign units. Additionally, when wall hung units are mounted adjacent to a floor surface another dimension of potential irregularity must be accommodated. With the advent of increased attention to cost and a resulting emphasis on rapid installation techniques, inherent misalignment tendencies have become exacerbated.

In the past at least some attention has been directed to alleviating such problems. In this connection, one previously known system envisioned the formation of a generally horizontal cut in the wall board to expose vertical structural studs. A wall member having a recess and lip would then be screwed against the studs. A structurally compatible member would be mounted upon the back of a cabinet and the cabinet would then be permanently hung on the wall member.

In another prior design, cabinet mounting rails were operably mounted upon a wall surface by adjustable mounting brackets. Cabinets and the like were then permanently supported from these rails.

Although the foregoing concepts offer at least a degree of theoretical appeal, prior designs have tended to be permanent mounting systems which were structurally elaborate and costly. Additionally, previously known systems required removal or destruction of a portion of a wall panel or stood away from the surface of the wall and thus occupied valuable interior room space. Still further such systems required a degree of skill for installation that discouraged use by unskilled workmen.

The difficulties suggested in the preceeding are not intended to be exhaustive, but rather are among many which have tended to reduce the effectiveness and satisfaction with prior methods and apparatus for hanging wall mounted units. Other noteworthy problems may also exist; however, those presented above should be sufficient to demonstrate that wall mounting units and techniques appearing in the past will admit to worthwhile improvement.

OBJECTS OF THE INVENTION

It is therefore a general object of the invention to provide a novel apparatus for hanging and aligning cabinets and the like which will obviate or minimize difficulties of the type previously described.

It is a specific object of the invention to provide a novel apparatus for temporarily hanging a cabinet or the like upon a wall surface such that alignment and permanent mounting to studs within a wall may be facilely achieved.

It is another object of the invention to provide a relatively cost effective apparatus for temporarily hanging a cabinet or the like wherein the cabinet may be permanently mounted directly against a wall surface without requiring modification or destruction of a portion of the wall surface.

It is yet another object of the invention to provide a temporary apparatus for hanging cabinets and the like wherein a single workman may hang relatively heavy cabinets in a plumb and precisely aligned posture.

It is a further object of the invention to provide a temporary apparatus for hanging cabinets and the like wherein relatively unskilled workmen may facilely achieve success in installing cabinets upon a generally vertical wall surface.

It is still a further object of the invention to provide a temporary apparatus for hanging cabinets and the like where a series of cabinets may be accurately and uniformly installed side-by-side in a secure aligned and plumb relationship.

It is yet still another object of the invention to provide a novel temporary hanging apparatus which will permit cabinets and the like to be accurately and quickly aligned such that conventional and time honored techniques may be used for permanent installation without requiring special tools or equipment.

It is yet a further object of the invention to provide a novel temporary hanging apparatus which will significantly reduce the time required for the installation of cabinets and the like.

It is still a further object of the invention to provide a temporary hanging apparatus which will effectively convert a rectangular cabinet or the like into a triangular configuration during installation alignment to pointedly locate a precise area to be "shimmed" for a "plumb" final mounting operation.

THE DRAWINGS

Other objects and advantages of the present invention will become apparent from the following detailed description of preferred embodiments thereof taken in conjunction with the accompanying drawings, wherein:

FIG. 1 is an axonometric view of cabinets installed in accordance with the subject invention upon generally vertical wall surfaces of a kitchen or the like;

FIG. 2 is an axonometric view of a wall mounting strip in accordance with a preferred embodiment of the invention;

FIG. 3 is a front view of the wall mounting strip depicted in FIG. 2;

FIG. 4 is an end view of the wall mounting strip depicted in FIG. 2;

FIG. 5 is a front view of a pair of wall mounting strips interlocked at mutually opposing ends and staped upon a wall surface to generally vertical structural studs;

FIG. 6 is an axonometric view of a cabinet mounting strip operable to be screwed or stapled to the back of a cabinet having a flush backing member;

FIG. 7 is a cross-sectional view of the cabinet mounting strip taken along section line 7—7 in FIG. 6 wherein the mounting strip is stapled to a flush backing member of a cabinet to be hung;

FIG. 8 is an axonometric view of an alternate preferred embodiment of a cabinet mounting strip for use with cabinets having a recessed backing member;

FIG. 9 is a cross-sectional view of the cabinet mounting strip taken along section line 9—9 in FIG. 8 wherein the mounting strip is stapled to a recessed backing member of a cabinet to be hung;

FIG. 10 is an axonometric view of yet another preferred embodiment of a cabinet mounting strip in accordance with the invention;

Figure 1:
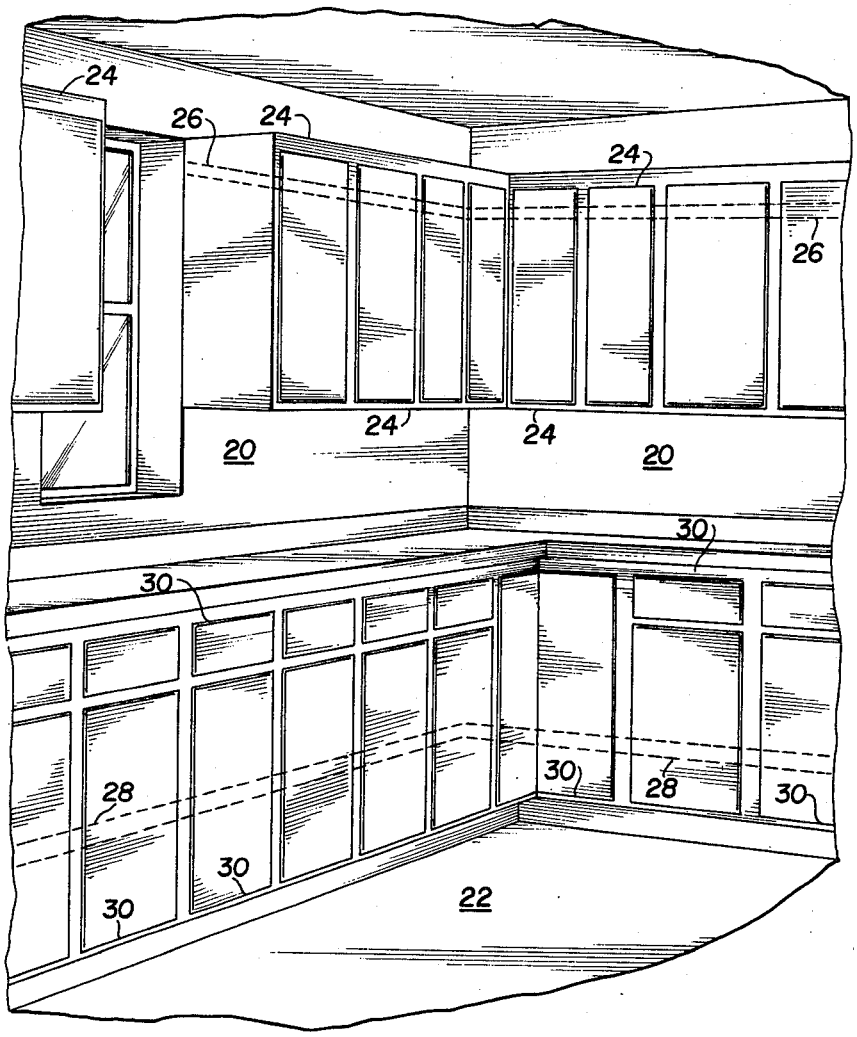

FIGS. 11 *a–c* disclose an operative sequence for temporary installation of cabinets upon a generally vertical wall surface in accordance with the invention; and FIG. 12 is a detailed cross-sectional view of a completed installation or permanent mounting of a cabinet wherein the subject temporary hanging and alignment structure is shown in a generally flattened posture against a wall surface.

DETAILED DESCRIPTION OF PREFERRED EMBODIMENTS OF THE INVENTION

Context of the Invention

Referring now to the drawings and particularly to FIG. 1 thereof, there will be seen an axonometric view of a setting where the instant invention has particular application. In this connection, FIG. 1 depicts a portion of a typical home kitchen having generally vertical wall surfaces 20 and a horizontal floor 22. A plurality of wall mounted cabinets 24 are aligned and abutted side-by-side, along an upper portion of the wall surface 20.

A temporary hanging and alignment apparatus 26 is shown in phantom behind the cabinets 24. This apparatus 26 comprises the subject matter of the instant invention. In a similar manner a temporary hanging and alignment apparatus 28 is shown in phantom behind wall mounted floor cabinets 30. This apparatus 28 is identical with hanging apparatus 26 and enables a relatively unskilled workman to readily align and position the cabinets 24 and 30 in a "plumb" secure posture for final installation by being screwed or nailed into wall studding in a conventional manner.

WALL MOUNTED MEMBER

Referring now to FIGS. 2–5, there will be seen various views of an elongate wall mounting member or strip 32 in accordance with a preferred embodiment of the invention.

More specifically the elongate member 32 comprises a generally rectangular strip of sheet metal 34 which may be pre-punched with a plurality of regularly spaced apertures 36. These aperatures are operable to receive stables, nails, screws, or the like 38 to mount or secure the strip in a horizontal posture through a conventional wall board 40 and securely into structural studding 42, note FIG. 5.

An upper lateral edge 44 of the sheet metal strip 34 is provided with a plurality of regularly spaced slits 46. Each of the slits 46 is fashioned to an equal depth and the edges are arcuately tapered outwardly to form a plurality of generally V-shaped notches in the upper lateral edge 44 of the strip 34.

The slits or notches 46 form a plurality of tabs 48 along the upper lateral edge. In a preferred embodiment alternate tabs are bent outwardly, note particularly FIGS. 2 and 4 and serve as receiving members for a cabinet mounted member as will be discussed more fully below.

As seen in FIG. 4 the strip 34 is bowed or bent arcuately away from its lateral edge such that upon positioning of the sheet metal strip 34 on a wall surface 40 the lateral edges contact the wall surface while a central longitudinal portion of the strip will be slightly spaced from the wall surface. The arcuate configuration provides stiffening properties and serves to act in cooperation with the outwardly bent tab members to form a longitudinal slot 51 operable to receive a cabinet hanging member as previously mentioned.

The ends of the elongate member or strip 34 are each fashioned with a mutually interengaging slot 52 which is preferably V-shaped. The slots 52 may be operably joined, note FIG. 5, to form a structural overlap joint such that individual elongate members 32 may be joined end-to-end across a horizontal wall expanse. Although continuous lengths of eight feet or more are contemplated by the invention, strips of twenty-six or thirty-four inches in length are preferred. In this regard such strips may be packed within conventional thirty inch cabinets during shipping and may be used with studs on sixteen or twenty-four inch centers without overlapping at a stud.

As previously indicated, the elongate member 32 is preferably composed of sheet metal. The gauge may be varied to suit the anticipated load but for most purposes will be thin enough to be somewhat flexible and readily handled and in some instances shaped by conventional tools. While sheet metal is preferred, it is contemplated that other materials may be utilized as desired such as reinforced plastic compositions and the like.

CABINET MOUNTED MEMBER

Referring now to FIGS. 6–10, there will be seen alternate preferred embodiments 50, 52 and 54 of a second elongate member operable to be secured to the back of a cabinet or the like to be mounted upon a generally vertical wall surface.

A first embodiment 50 of the second elongate member is depicted in FIGS. 6 and 7. In this embodiment, a generally flat mounting portion 56 is provided with a plurality of regularly spaced apertures 58 operable to receive a staple, nail, screw or the like to mount the elongate member upon the back 60 of a cabinet.

The elongate member 50 further includes a lateral edge portion 62 which slopes away from the mounting portion and is united thereto by a reversely bent connection portion 64 extending between the mounting portion and the sloping lateral edge portion. The outer extreme of the lateral edge terminates in a straight edge 66 which is operable to be received within notch 51, note FIG. 4. The vertical component of the lateral edge portion 62 is preferably greater than the depth of the notches 46. Accordingly, the edge 66 will rest against the base of the slit 46 to support a wall cabinet in a hanging posture on a wall surface.

The end edges 68 and 70 of the lateral edge portion 62 slope inwardly toward the bearing edge 66 in order to facilitate lateral shifting of the edge portion 62 within the slots 46 to horizontally align a cabinet temporarily hanging from the elongate member 32.

A second embodiment 52 of the second elongate member is shown in FIGS. 8 and 9 and is particularly useful with a cabinet having a recessed backing member. In a manner similar to the first embodiment 50 the second embodiment 52 is fashioned with a generally flat mounting plate 72 having a plurality of regularly spaced apertures 74 operable to receive staples and the like to secure the mounting plate to a recessed backing portion 75 of a cabinet. The second embodiment 52, further, like the first embodiment, includes a lateral edge portion 76 which slopes away from the generally flat mounting plate 72.

As opposed to the first embodiment, however, the second embodiment 52 inclues an offset connection portion 78 which extends perpendicularly away from a lower edge of the flat base member 72. The offset connection portion 78 then turns into a vertically descending connection portion 80 which connects into an outer edge 82 of the lateral edge portion 76.

The outer edge 82, in a manner identical to outer edge 66 is operably received within the slot 50 formed behind tabs 48 in the wall mounted elongate strip to temporarily support the cabinet upon a wall surface.

The ends of the lateral edge portion 76 as well as the ends 81 and 86 of the connection portion 80 are sloped inwardly toward the edge 82 to facilitate transverse sliding of the edge 82 within the base of support slits 46 as previously discussed in connection with the first embodiment.

Finally, a third preferred embodiment of the second elongate member is disclosed in FIG. 10. This embodiment is identical to the second embodiment with respect to a flat mounting plate 84, an offset connection portion 86, a vertically descending connection 88, and a lateral edge portion 90. As to these members, the preceding description of corresponding elements 72, 76, 78 and 80 are repeated by reference as though set forth at length.

In addition to the foregoing, however, the third embodiment 54 includes a second flat mounting plate or base member 92 which lies within an imaginery extension of the plane of the first mounting member 84.

This third embodiment 54 is preferably composed of a continuous sheet of sheet metal, although other materials may be utilized, bent into the desired configuration and finds particular utility with very heavy cabinets and the like.

METHOD OF UTILIZATION

Having described the structural aspects of first and second elongate members operable for temporarily hanging and aligning cabinets and the like a method of advantageous utilization is sequentially depicted in FIGS. 11*a–c*.

In FIG. 11*a*, first elongate members 96 and 98 are horizontally mounted across a wall surface in a manner previously shown in FIG. 5. The elongate member 96 is mounted in an elevated posture for an upper set of hanging cabinets 99 while the strip 98 is mounted adjacent to a floor surface for a bottom set of cabinets 100.

The elongate member 96 and 98 may be readily located in a horizontal position by use of a chalk line or the like.

Second elongate members 101 and 102 respectively are stapled to the back of the cabinets and the cabinets are lifted onto the wall mounted strips 96 and 98 as shown by directional arrows 104 and 106.

The vertical location of the first elongate mounting strips 96 and 98 was preselected to provide the desired elevation for the upper set of cabinets and such that the highest point on the floor surface would be contacted by the lower set of cabinets.

Once positioned, the sloping surfaces of the connecting members guides the cabinets onto a plumb hanging posture against the wall surfaces. The cabinets may then be laterally positioned by a single workman, note the directional arrows 108 and 110 in FIG. 11*b*, until the exact desired position is achieved.

Unless the wall is perfectly flat, the upper rectangular cabinet will be supported by three points (two on the wall mounting and one on the wall surface). If the bottom edges of the cabinet do not contact the wall shims may be inserted to take up the gap and the cabinet may be permanently and securely screwed into the wall studs.

In a somewhat similar manner, the bottom cabinets are mounted upon the wall mounting member 98. The wall mounting unit and at least one portion of the front edge of the base will establish a three point bearing which will reveal any floor irregularity which will require a shim to firmly secure four corners of the cabinet. In this secure posture, the cabinet is again permanently screwed or nailed to wall studding or the floor to present a completed installation flush with the wall surface 112 as shown in FIG. 11*c*.

FIG. 12 is a partially cut away view of the subject temporary hanging and alignment apparatus after a cabinet is permanently installed. In this regard, the sheet metal members 96 and 101 are flexible enough to be readily collapsed together and permit a flush final installation of the cabinet or the like against the wall surface.

SUMMARY OF MAJOR ADVANTAGES OF THE INVENTION

In describing an apparatus for temporarily hanging and aligning cabinets and the like in accordance with preferred embodiments of the invention, those skilled in the art will recognize several advantages which singularly distinguish the invention from previously known structures.

A particular advantage of the invention entails the utilization of a "tab" system on the metal strip. This permits the strip to be installed on the surface of a wall without major interference with the appearance of the cabinets or other devices to be installed. This is accomplished because the thickness of the metal strip is minimal and the strip compresses to the wall surface when additional screws are used to affix the cabinet to the wall.

The device is primarily an alignment device for the installation of hanging objects, however, the strength of the metal determines its load bearing capabilities. This device removes much of the skill required to install wall hanging objects because it satisfactorily holds the load in place in a plumb configuration while permanent installation is underway. Since a plurality of strips may be installed to form any desired horizontal length, a series of objects may be attached to the wall surface.

The subject apparatus requires virtually no modification of the wall to which it is attached, and, in some cases, requires little if any modification to the hanging object. The subject apparatus can be produced in various lengths to conform to the object to be installed, yet, these lengths can be joined without fasteners to form a contiguous pattern.

The subject invention requires no other special tools or equipment to install and is very cost efficient. The use of this device will permit one person to install a series of hanging objects on a vertical surface without assistance and without experience in this type of installation.

The subject apparatus is believed to be highly useful in the cabinet industry and will encourage unskilled and inexperienced individuals to satisfactorily use cabinet products in a cost efficient way.

Finally, the subject apparatus temporarily converts a rectangular object to a triangular configuration during installation alignment and simplifies the transformation back to a rectangle by pointedly showing the precise area to be "shimmed" for a "plumb" location.

In describing the invention, reference has been made to preferred embodiments. Those skilled in the art, however, and familiar with the disclosure of the subject invention, may recognize additions, deletions, modifications, substitutions and/or other changes which will fall within the purview of the subject invention as defined by the following claims.

I claim:

1. An aligning apparatus for temporarily hanging and aligning cabinets and the like upon a generally vertical wall surface, said apparatus comprising:

a first elongate member having an upper edge and a lower edge and operable to be mounted in a horizontal posture upon a generally vertical wall surface, said first elongate member having a plurality of parallel slits cut inwardly and downwardly from said upper edge and of equal length so as to have slit bottoms terminating along a line parallel to said upper edge and forming a plurality of tabs so that when said tabs are bent outwardly from said wall at an acute angle with said wall, V-shaped slots are formed parallel to said wall surface;

a second elongate member operable to be secured upon a backing member of a cabinet or the like to be mounted upon said generally vertical wall surface, said second elongate member having, a generally flat mounting portion operable to be secured to the backing member of the cabinet or the like, and a lateral edge portion angled away from said mounting portion, wherein said first elongate member, when horizontally installed across a wall surface with said plurality of V-shaped slots directed upwardly, can be cooperatively engaged by the later edge portion of said second elongate member mounted upon the back of a cabinet or the like whereby the cabinet may be temporarily hung upon the wall surface in a plumb posture and lateral positioning of the cabinet may be achieved by sliding said lateral edge portion of said second elongate member within said slots of said first elongate member prior to permanently securing the cabinet to the wall surface, and said first and second elongated members being of material of sufficient strength to support said cabinet and of sufficient flexibility to collapse into a generally planar as permanent securement means push said backing member against said wall.

2. An apparatus for temporarily hanging and aligning cabinets and the like upon a generally vertical wall surface as defined in claim 1 wherein:

said first elongate member is composed of sheet metal and is slightly arcuate in cross-section wherein the lateral edges of said first elongate member operably contact a wall surface while a central longitudinal portion of said first elongate member is slightly spaced therefrom.

3. An apparatus for temporarily hanging and aligning cabinets and the like upon a generally vertical wall surface as defined in claim 1 wherein:

each of said slits in said first elongate member taper outwardly from a base portion thereof to the lateral edge of said first elongate member to form a plurality of generally V-shaped recesses within the edge of said first elongate member.

4. An apparatus for temporarily hanging and aligning cabinets and the like upon a generally vertical wall surface as defined in claim 3 wherein:

said tapered slits have arcuately contoured side walls for facilitating reception of the lateral edge of said second elongate member and further for facilitating lateral sliding action of the lateral edge of said second elongate member within said slits during a cabinet alignment operation.

5. An apparatus for temporarily hanging and aligning cabinets and the like upon a generally vertical wall surface as defined in claim 1, 2, 3 or 4 wherein:

said slits are formed to a uniform depth and the lateral extent of said lateral edge portion of said second elongate member is greater than the depth of said slits whereby the edge of said lateral edge portion rests upon the base of said slits such that a cabinet may be temporarily hung upon the wall surface.

6. An apparatus for temporarily hanging and aligning cabinets and the like upon a generally vertical wall surface as defined in claim 1 wherein:

the ends of said first elongate member are each fashioned with means for mutually interengaging whereby said first elongate member may be joined with another elongate member end to end.

7. An apparatus for temporarily hanging and aligning cabinets and the like upon a generally vertical wall surface as defined in claim 6 wherein:

said means for interengaging comprises a V-notch cut longitudinally into each end of said first elongate member.

8. An apparatus for temporarily hanging and aligning cabinets and the like upon a generally vertical wall surface as defined in claim 1, 2 or 4 wherein:

alternate tabs formed along the lateral surface of said first elongate member are inclined outwardly with respect to the remaining tabs.

9. An apparatus for temporarily hanging and aligning cabinets and the like upon a generally vertical wall surface as defined in claim 1, 2, 3 or 6 wherein:

said mounting portion of said second elongate member comprises a flat base member operable to be positioned against a back portion of a cabinet or the like to be wall mounted and a reversely bent connection portion extending between said flat base member and said lateral edge portion.

10. An apparatus for temporarily hanging and aligning cabinets and the like upon a generally vertical wall surface as defined in claim 1, 2, 3 or 6 wherein:

said mounting portion of said second elongate member comprises a flat base member operable to be positioned against a recessed back portion of a cabinet or the like to be wall mounted and an offset connection portion extending outwardly from said base member for connecting to said lateral edge portion of said second elongate member.

11. An apparatus for temporarily hanging and aligning cabinets and the like upon a generally vertical wall surface as defined in claim 10 wherein:

said second elongate member comprises a single, shaped, sheet metal member wherein said offset connection portion extends perpendicularly away from a lower edge of said flat base member a distance equal to the cabinet offset and then downwardly to connect to an outer edge of said lateral edge portion, said lateral edge portion sloping upward from said outer edge toward said flat base member until the lateral edge portion reaches an imaginary plane comprising an extension of said flat base member and then downwardly within said imaginery plane to form a second flat base member operable to be positioned against a recessed back portion of a cabinet to be wall mounted.

12. An apparatus for temporarily hanging and aligning cabinets and the like upon a generally vertical wall surface as defined in claim 1, 2, 4, or 6 wherein:

each end of said lateral edge portion of said second elongate member is angled inwardly toward the outer edge thereof to facilitate lateral tracking motion of said second elongate member with respect to said first elongate member.

* * * * *